US011015820B2

(12) United States Patent
Muramatsu et al.

(10) Patent No.: US 11,015,820 B2
(45) Date of Patent: May 25, 2021

(54) OUTDOOR UNIT AND AIR CONDITIONER

(71) Applicant: Mitsubishi Electric Corporation, Tokyo (JP)

(72) Inventors: Masaki Muramatsu, Tokyo (JP); Keiji Harada, Tokyo (JP); Shinji Murata, Tokyo (JP); Shinsaku Kusube, Tokyo (JP); Osamu Morimoto, Tokyo (JP); Shigetoshi Ipposhi, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 50 days.

(21) Appl. No.: 16/468,090

(22) PCT Filed: Dec. 4, 2017

(86) PCT No.: PCT/JP2017/043424
§ 371 (c)(1),
(2) Date: Jun. 10, 2019

(87) PCT Pub. No.: WO2018/110340
PCT Pub. Date: Jun. 21, 2018

(65) Prior Publication Data

US 2019/0360705 A1 Nov. 28, 2019

(30) Foreign Application Priority Data

Dec. 16, 2016 (JP) ..... JP2016-244345

(51) Int. Cl.
*F24F 1/24* (2011.01)
*F24F 1/50* (2011.01)
(Continued)

(52) U.S. Cl.
CPC ..... *F24F 1/24* (2013.01); *F24F 1/50* (2013.01); *F24F 1/22* (2013.01); *F24F 1/38* (2013.01);
(Continued)

(58) Field of Classification Search
CPC ..... F24F 1/24; F24F 1/50; F24F 11/74; F24F 1/22; F24F 1/38; F24F 2013/207
See application file for complete search history.

(56) References Cited

U.S. PATENT DOCUMENTS

2002/0134099 A1* 9/2002 Mochizuki ..... F24F 1/46 62/285
2005/0144975 A1* 7/2005 Fuchikami ..... F24F 1/22 62/508

FOREIGN PATENT DOCUMENTS

EP 1684022 A1 7/2006
JP H0989308 A 4/1997
(Continued)

OTHER PUBLICATIONS

Office Action dated May 12, 2020 issued in corresponding Japanese Patent Application No. 2018-556582, 10 pages including 5 pages of English translation.
(Continued)

*Primary Examiner* — Emmanuel E Duke
(74) *Attorney, Agent, or Firm* — Buchanan Ingersoll & Rooney PC

(57) ABSTRACT

An outdoor unit comprises a casing, a fan, a heat exchanger, an electrical component, a heat radiation member, and a duct. The casing is provided with an air outlet. The fan is disposed inside the casing and configured to blow air to the outside of the casing via the air outlet. The heat exchanger is disposed inside the casing at a position lower than the fan. The electrical component is disposed inside the casing at a position lower than the heat exchanger. The heat radiation member is connected to the electrical component inside the casing. The duct is configured to accommodate at least part of the heat radiation member inside the casing and extend in the vertical direction. An upper end of the duct is configured
(Continued)

to protrude upward higher than a lower end of the heat exchanger.

10 Claims, 11 Drawing Sheets

(51) Int. Cl.

| | |
|---|---|
| *F24F 11/74* | (2018.01) |
| *F24F 1/22* | (2011.01) |
| *F24F 1/38* | (2011.01) |
| *F24F 13/20* | (2006.01) |

(52) U.S. Cl.
CPC ..... *F24F 11/74* (2018.01); *F24F 2013/207* (2013.01)

(56) References Cited

FOREIGN PATENT DOCUMENTS

| | | | |
|---|---|---|---|
| JP | 2003214659 A | | 7/2003 |
| JP | 2005098625 A | | 4/2005 |
| JP | 2006125696 A | | 5/2006 |
| JP | 2008082632 A | * | 4/2008 |
| JP | 2008082632 A | | 4/2008 |
| JP | 2009068743 A | | 4/2009 |
| JP | 2010169393 A | | 8/2010 |
| WO | 2015098157 A1 | | 7/2015 |

OTHER PUBLICATIONS

Extended European Search Report dated Nov. 28, 2019 for corresponding European patent application No. 17880541.2, 8 pages.
International Search Report (PCT/ISA/210) dated Feb. 6, 2018, by the Japan Patent Office as the International Searching Authority for International Application No. PCT/JP2017/043424.
Written Opinion (PCT/ISA/237) dated Feb. 6, 2018, by the Japan Patent Office as the International Searching Authority for International Application No. PCT/JP2017/043424.
Office Action (Decision for Refusal) dated Sep. 29, 2020, by the Japanese Patent Office in corresponding apanese Patent Application No. 2018-556582 and English translation of the Office Action. (6 pages).

* cited by examiner

OUTDOOR UNIT AND AIR CONDITIONER

TECHNICAL FIELD

The present invention relates to an outdoor unit and an air conditioner, and in particular to a structure for cooling an outdoor unit for an air conditioner.

BACKGROUND ART

Conventionally, an outdoor unit for an air conditioner includes a heat exchange chamber where a fan, a heat exchanger and the like are disposed, and a machinery room where an electrical component and the like are disposed. Such an outdoor unit for an air conditioner is described, for example, in Japanese Patent Laying-open No. 2010-169393 (PTL 1).

In the outdoor unit for an air conditioner described in the above publication, a casing of the outdoor unit is partitioned in the vertical direction by a horizontal partition plate, the heat exchange chamber is arranged above the horizontal partition plate, and the machinery room is arranged below the horizontal partition plate. The heat exchanger is arranged in the heat exchange chamber along a wall surface of the casing. The fan is mounted at the top of the heat exchange chamber. As the fan rotates, the air outside the outdoor unit is sucked into the outdoor unit, and thereby, refrigerant flowing through the heat exchanger exchanges heat with the air sucked into the outdoor unit inside the heat exchange chamber. In order to cool the electrical component disposed in the machinery room, a heat sink is connected to the electrical components. The heat sink protrudes into a cooling duct through which the air sucked into the outdoor unit passes. The cooling duct has one opening provided on the horizontal partition plate and the other opening provided on the bottom face of the machinery room.

CITATION LIST

Patent Literature

PTL 1: Japanese Patent Laying-open No. 2010-169393

SUMMARY OF INVENTION

Technical Problem

In the outdoor unit for an air conditioner described in the above publication, since the opening at the upper end of the cooling duct is provided on the horizontal partition plate which constitutes the bottom face of the heat exchange chamber, the opening at the upper end of the cooling duct is separated from the fan with a certain distance. Therefore, it is difficult to increase the flow rate of the air flowing through the cooling duct fast enough to sufficiently cool the heat sink (heat radiation member) by using the air flowing through the cooling duct.

The present invention has been made in view of the above problem, and an object thereof is to provide an outdoor unit capable of sufficiently cooling a heat radiation member, and an air conditioner including the same.

Solution to Problem

The outdoor unit of the present invention includes a casing, a fan, a heat exchanger, an electrical component, a heat radiation member, and a duct. The casing is provided with an air outlet. The fan is disposed inside the casing and configured to blow air to the outside of the casing via the air outlet. The heat exchanger is disposed inside the casing at a position lower than the fan. The electrical component is disposed inside the casing at a position lower than the heat exchanger. The heat radiation member is connected to the electrical component inside the casing. The duct is configured to accommodate at least a part of the heat radiation member inside the casing and extend in the vertical direction. An upper end of the duct is configured to protrude upward higher than a lower end of the heat exchanger.

Advantageous Effects of Invention

According to the outdoor unit of the present invention, since the upper end of the duct is configured to protrude upward higher than the lower end of the heat exchanger, the upper end of the duct may be brought closer to the fan than the lower end of the heat exchanger. Therefore, it is possible to increase the flow rate of the air flowing upward around the upper end of the duct. The air flowing upward around the upper end of the duct will draw the air inside the duct upward, whereby it is possible to increase the flow rate of the air flowing inside the duct. As a result, the heat radiation member may be sufficiently cooled by the air flowing inside the duct.

DESCRIPTION OF EMBODIMENTS

Hereinafter, embodiments of the present invention will be described with reference to the drawings.

First Embodiment

With reference to FIGS. 1 to 4, the configuration of an outdoor unit according to a first embodiment of the present invention will be described. The outdoor unit of the present embodiment is an outdoor unit for an air conditioner.

Figure 1:
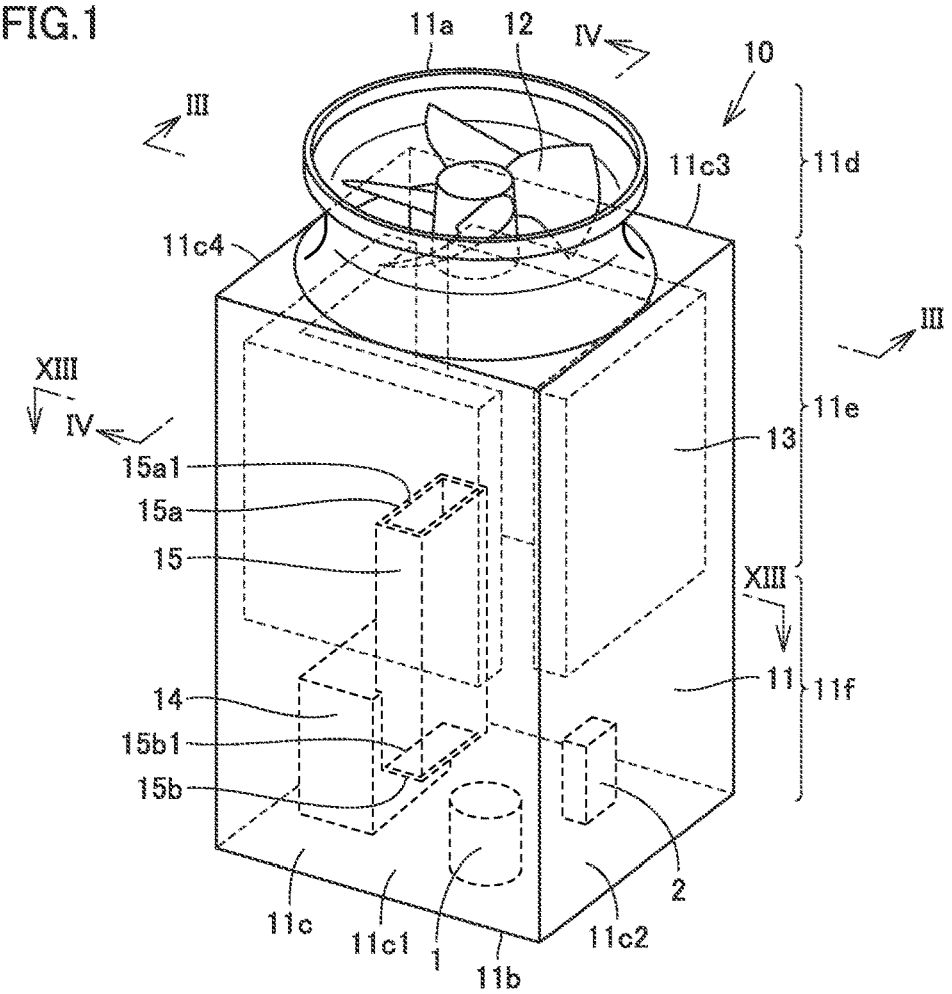
FIG. 1 is a perspective view schematically illustrating the configuration of an outdoor unit according to a first embodiment of the present invention.

FIG. 1 illustrates an overall view of an outdoor unit 10. As illustrated in FIG. 1, the outdoor unit 10 mainly includes a casing 11, a fan 12, a heat exchanger 13, a control box 14, and a duct 15. In addition, the outdoor unit 10 includes a compressor 1 and a throttle device 2, which will be described later. The compressor 1, the throttle device 2, the fan 12, the heat exchanger 13, the control box 14 and the duct 15 are disposed inside the casing 11.

The casing 11 has an air outlet 11*a*, a bottom face 11*b*, and a side face 11*c*. The air outlet 11*a* is provided at the upper end of the casing 11. The air outlet 11*a* is provided on the side opposite to the bottom face 11*b*. The bottom face 11*b* covers the entire lower end of an internal space of the casing 11. No opening is provided on the bottom face 11*b*. In other words, the bottom face 11*b* of the casing 11 is completely closed. The side face 11*c* is arranged so as to rise from the outer peripheral edge of the bottom face 11*b*.

In the present embodiment, the side face 11*c* of the casing 11 includes a first side face 11*c*1, a second side face 11*c*2, a third side face 11*c*3, and a fourth side face 11*c*4. The second side face 11*c*2 is connected to the first side face 11*c*1. The third side face 11*c*3 is connected to the second side face 11*c*2. The third side face 11*c*3 is configured to face the first side face 11*c*1. The fourth side face 11*c*4 is connected to the first side face 11*c*1 and the third side face 11*c*3. The fourth side face 11*c*4 is configured to face the second side face 11*c*2.

Figure 13:
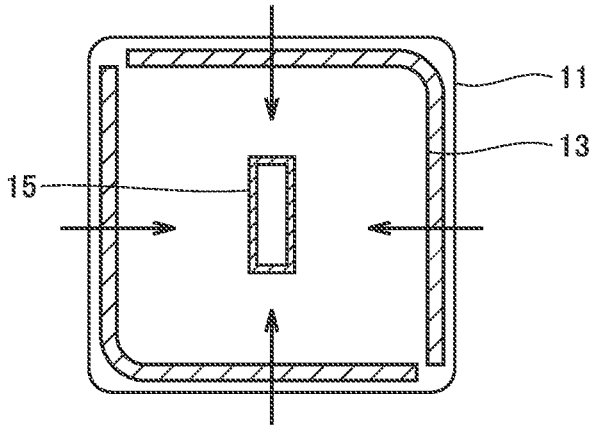
FIG. 13 is a cross-sectional view taken along a line XIII-XIII in FIG. 1.

The casing 11 is constituted by three sections, i.e., a fan section 11*d*, a heat exchange section 11*e*, and a machinery section 11*f*. The fan section 11*d* is arranged at the uppermost part of the casing 11. The heat exchange section 11*e*is arranged below the fan section 11*d*. The machinery section 11*f* is arranged below the heat exchange section 11*e*. The heat exchange section 11*e*and the machinery section 11*f* communicate with each other in both the duct 15 and the region around the duct 15. In other words, the heat exchange section 11*e*and the machinery section 11*f* are not separated from each other, and more specifically, the heat exchange section 11*e*and the machinery section 11*f* are not partitioned by a plate or the like. The machinery section 11*f* refers to a lower section of the outdoor unit 10 which is located below the heat exchange section 11*e*and provided with no suction port 11*e*1 (see FIG. 3) on its side face. FIG. 13 is a sectional view taken along a line XIII-XIII of FIG. 1. Since the duct 15 is disposed at a center portion of an area surrounded by the heat exchanger 13, the air flow in the duct can be promoted. As an example, the duct 15 may be suitably designed to include the central point of the area surrounded by the heat exchanger 13.

The air outlet 11*a* is provided at the upper end of the fan section 11*d*. The fan 12 is installed inside the fan section 11*d*. The fan 12 is disposed inside the casing 11. The fan 12 is configured to blow air to the outside of the casing 11 via the air outlet 11*a*. The fan 12 is, for example, a propeller fan.

The heat exchanger 13 is disposed inside the heat exchange section 11*e*. The heat exchanger 13 is disposed inside the casing 11 at a position lower than the fan 12.

The heat exchanger 13 is disposed inside the heat exchange section 11*e*along the side face 11*c*. Specifically, the heat exchanger 13 is disposed inside the heat exchange section 11*e*along each of the first side face 11*c*1, the second side face 11*c*2, the third side face 11*c*3, and the fourth side face 11*c*4.

Figure 3:
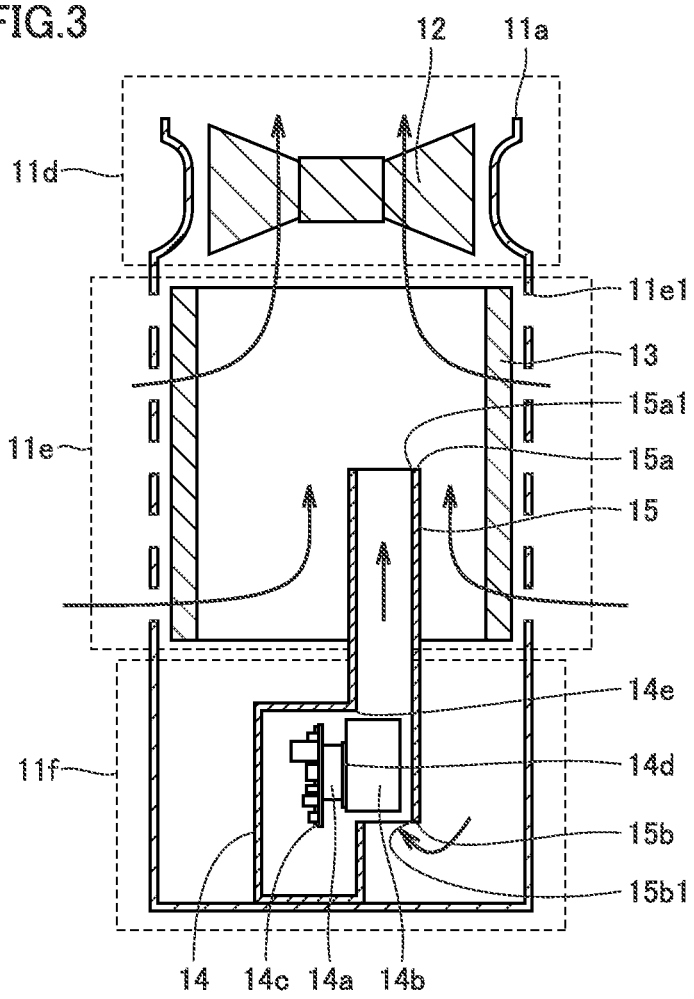
FIG. 3 is a cross-sectional view taken along a line in FIG. 1.

The side wall of the heat exchange section 11*e*is provided with suction ports 11*e*1 (see FIG. 3). For the purpose of a clear view, the suction ports 11*e*1 provided in the heat exchange section 11*e*are not illustrated in FIG. 1. Along with the rotation of the fan 12, the air outside the outdoor unit 10 is sucked into the outdoor unit 10 via the suction ports 11*e*1 (see FIG. 3) provided in the heat exchange section 11*e*. The air sucked into the outdoor unit 10 via the suction ports 11*e*1 (see FIG. 3) provided in the heat exchange section 11*e*passes through the heat exchange section 11*e*and the fan section 11*d*, and is vented upward from the air outlet 11*a* provided at the upper end of the fan section 11*d*. As illustrated in FIG. 13, since the duct 15 is disposed at a certain distance from the heat exchanger 13, it will not block any of the suction ports 11*e*1, ensuring an air passage from the suction ports 11*e*1 to the air outlet 11*a*.

Figure 2:
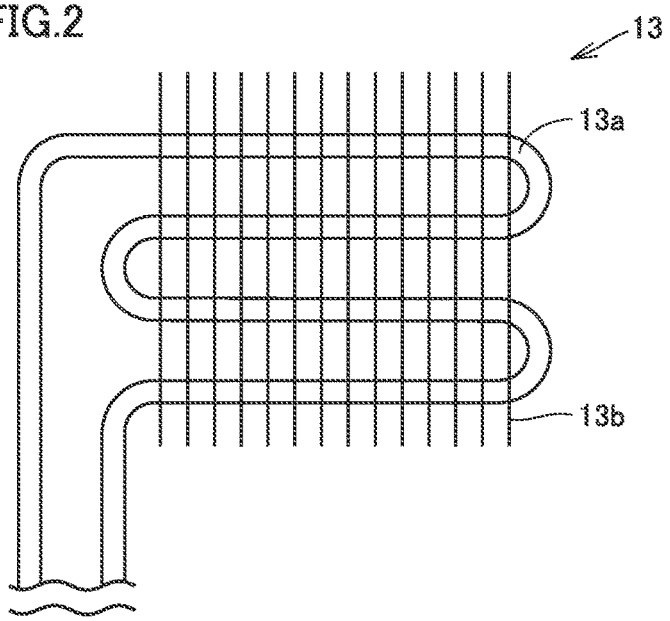
FIG. 2 is a side view schematically illustrating the configuration of a heat exchanger provided in the outdoor unit according to the first embodiment of the present invention.

FIG. 2 illustrates a schematic view of the heat exchanger 13. The heat exchanger 13 includes a refrigerant pipe 13*a* and a plurality of thin metal plates (fins) 13*b*. The refrigerant pipe 13*a* is sealed with refrigerant. The refrigerant is used in a refrigeration cycle for transferring heat between the indoor unit and the outdoor unit of the air conditioner.

The temperature of the refrigerant inside the refrigerant pipe 13*a* provided in the heat exchanger 13 changes along with different operation modes of the air conditioner. In a heating mode for heating a room in winter, the temperature of the refrigerant is cooler than the surrounding air. In a cooling mode for cooling a room in summer, the temperature of the refrigerant is warmer than the surrounding air. Thus, when the air flow generated by the rotation of the fan 12 is brought into contact with the refrigerant pipe 13*a* and the metal plates 13*b* of the heat exchanger 13, the air flow absorbs heat in the heating mode and radiates heat in the cooling mode. In addition, the refrigerant pipe 13*a* is formed into a meandering shape so that the refrigerant pipe 13*a* passes through the metal plates 13*b* for plural times. Therefore, the contact area between the refrigerant pipe 13*a* and the metal plates 13*b* is increased, which makes it possible to improve the heat transfer coefficient between the refrigerant pipe 13*a* and the metal plates 13*b*.

Figure 4:
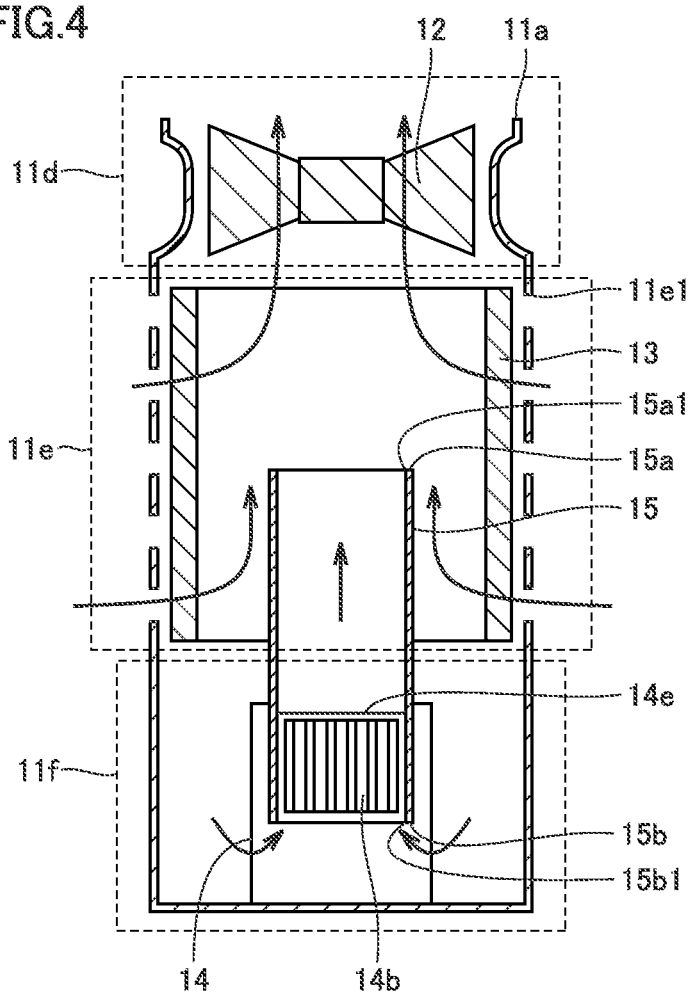
FIG. 4 is a cross-sectional view taken along a line IV-IV in FIG. 1.

In the present embodiment, the heat exchanger 13 is disposed along all the wall surfaces of the heat exchange section 11*e*. Thereby, the control box 14 can not be attached to the wall surface of the heat exchange section 11*e*, it is installed in the machinery section 11*f* instead. FIG. 3 and FIG. 4 illustrate a cross-sectional view of the outdoor unit 10. As illustrated in FIGS. 3 and 4, an electrical component 14*a* is mounted inside the control box 14. The electrical component 14*a* is disposed inside the casing 11 at a position lower than the heat exchanger 13. The electrical component 14*a* is disposed in the machinery section 11*f*. The electrical component 14*a* is a heat generating component. A heat radiation member 14*b* is connected to the electrical component 14*a* inside the casing 11.

In the present embodiment, a semiconductor module will be described as an example of the electrical component 14*a*. The compressor 1 illustrated in FIG. 1 is installed in the outdoor unit 10. The compressor 1 is driven by the semiconductor module. In the present embodiment, the semiconductor module is constituted by a rectifier circuit configured to convert an AC power into a DC power, a converter circuit configured to alter the magnitude of voltage of the converted DC power, and an inverter circuit configured to convert the DC power into an AC power. The described elements of the semiconductor module are merely examples. Depending on the output capacity of the outdoor unit 10, the converter circuit may not be mounted on the semiconductor module. The rectifier circuit and the inverter circuit may be mounted on separate semiconductor modules.

The semiconductor module is fixed to a printed circuit board 14*c* via soldering. When a current required to drive the compressor 1 is supplied to flow through each circuit constituting the semiconductor module, the semiconductor module will generate heat, and the heat is required to be radiated from the semiconductor module.

Therefore, the heat radiation member 14*b* is disposed in such a manner that it is in contact with a surface of the semiconductor module opposite to the surface soldered to the printed circuit board 14*c*.

The heat radiation member 14*b* is a air cooling member having a large heat radiation area. The heat radiation member 14*b* is, for example, a heat radiation fin. In the present embodiment, a heat radiation fin is used as the heat radiation member 14*b*. The feathers of the heat radiation fin are arranged parallel to the vertical direction.

Generally, minute pimples and dimples, which are invisible with naked eyes, may be present on the heat radiation member 14*b*. Therefore, when the heat radiation member 14*b* is brought into direct contact with the electrical component 14*a*, the contact thermal resistance is large, which may decrease the thermal conductivity. Therefore, a heat conduction member 14*d* is inserted between the semiconductor module and the heat radiation member 14*b* so as to fill the minute pimples and dimples present on the contact surface therebetween. The heat conduction member 14*d* is, for example, a heat conductive sheet or a heat conductive grease. Since the minute pimples and dimples are filled by the heat conduction member 14*d*, the thermal conductivity is improved.

The control box 14 is provided with an opening 14*e*. The heat radiation member 14*b* in contact with the semiconductor module protrudes to the outside of the control box 14 through the opening 14*e* of the control box 14.

The heat radiation member 14*b* protruding to the outside of the control box 14 is accommodated in the duct 15. The duct 15 is configured to accommodate at least a part of the heat radiation member 14*b* inside the casing 11. The duct 15 is configured to extend in the vertical direction.

The duct 15 is configured to have a cylindrical shape. The duct 15 opens at both ends. In other words, the duct 15 has an opening 15*a*1 provided at an upper end 15*a* and an opening 15*b*1 provided at a lower end 15*b*. The duct 15 is attached to the control box 14. The duct 15 is made of, for example, a metal sheet, and the heat radiation member 14*b* is enclosed by the metal sheet constituting the duct which opens at both ends. The duct 15 is formed linear in the vertical direction. Thereby, it is possible to reduce the amount of the metal sheet to be used as compared with the case where the duct 15 is made curved, and it is also possible to reduce the ventilation resistance of the air flowing inside the duct 15, which makes it possible to reduce the pressure loss.

The upper end 15*a* of the duct 15 protrudes upward higher than the lower end of the heat exchanger 13. The upper end 15*a* of the duct 15 may protrude upward higher than a middle point between the upper end and the lower end of the heat exchanger 13. The opening 15*a*1 at the upper end 15*a* of the duct 15 is at least located in the heat exchange section 11*e*. The upper end 15*a* of the duct 15 extends into the air passage of the heat exchange section 11*e*.

When the fan 12 installed in the fan section 11*d* rotates, an air flow is generated in the heat exchange section 11*e*toward the upper direction. Therefore, due to the rotation of the fan 12, an air flow is generated around the opening 15*a*1 at the upper end 15*a* of the duct 15 toward the upper direction. Due to this air flow, the air around the opening 15*a*1 at the upper end 15*a* of the duct 15 and the air inside the duct 15 are drawn upward. Since the air inside the duct 15 is drawn upward, an air flow is generated inside the duct 15 in the upward direction. In other words, the air flows inside the duct 15 from the opening 15*b*1 at the lower end 15*b* of the duct 15 toward the opening 15*a*1 at the upper end 15*a*.

No suction port is provided on the side face of the machinery section 11*f*. Since there is no suction port provided on the side face, it is possible to supply an air flow in the upward direction to the heat radiation member 14*b* installed in the machinery section 11*f* which is a substantially windless environment with only natural convection. As a result, since the amount of wind required for heat radiation is supplied to the heat radiation member 14*b*, the heat radiation member 14*b* may be made smaller in size as compared with the case where the heat radiation member 14*b* is not accommodated in the duct 15.

Figure 5:
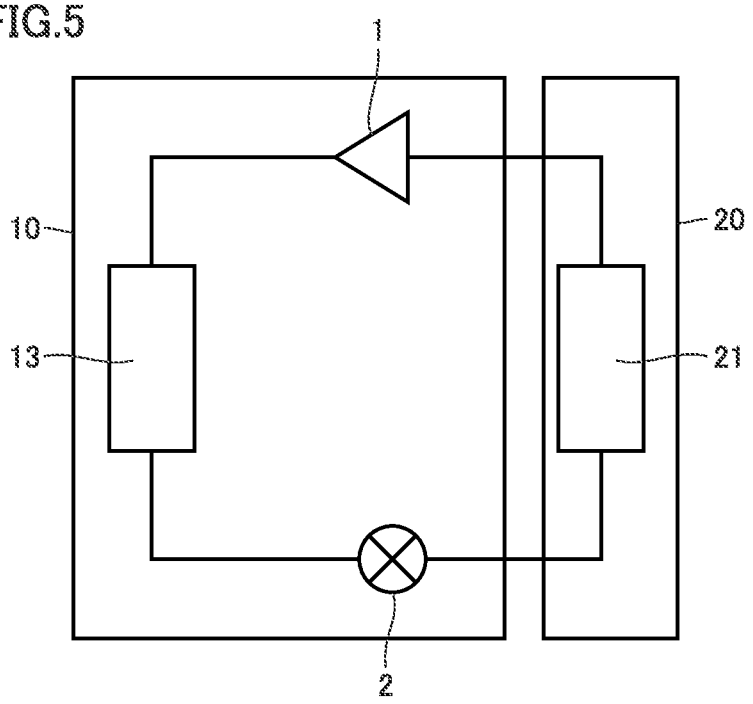
FIG. 5 is a refrigeration circuit diagram schematically illustrating the configuration of an air conditioner according to the first embodiment of the present invention.

Hereinafter, the configuration of an air conditioner 100 according to the first embodiment of the present invention will be described with reference to FIG. 5.

The air conditioner 100 of the present embodiment includes the outdoor unit 10 described above and an indoor unit 20. The outdoor unit 10 is generally installed in an outdoor space. The outdoor unit 10 includes the compressor 1, the heat exchanger (outdoor heat exchanger) 13, and the throttle device 2. The indoor unit 20 is generally installed in a human living space or the like. The indoor unit 20 includes an indoor heat exchanger 21.

The compressor 1, the heat exchanger (outdoor heat exchanger) 13, the throttle device 2, and the indoor heat exchanger 21 are connected via a pipeline to constitute a refrigerant circuit. The refrigerant is configured to be circulated in the refrigerant circuit in the order of the compressor 1, the heat exchanger (outdoor heat exchanger) 13, the throttle device 2, and the indoor heat exchanger 21.

The compressor 1 is configured to compress the sucked refrigerant and discharge the compressed refrigerant. The compressor 1 may be configured to have a variable capacity. The heat exchanger (outdoor heat exchanger) 13 is configured to condense the refrigerant compressed by the compressor 1. As illustrated in FIG. 2, the heat exchanger (outdoor heat exchanger) 13 is an air heat exchanger constituted by the refrigerant pipe 13*a* and the metal plates 13*b*. The throttle device 2 is configured to decompress the refrigerant condensed by the heat exchanger (outdoor heat exchanger) 13. The throttle device 2 is, for example, an expansion valve. The indoor heat exchanger 21 is configured to evaporate the refrigerant decompressed by the throttle device 2. Similar to the heat exchanger (outdoor heat exchanger) 13, the indoor heat exchanger 21 may be an air heat exchanger constituted by a refrigerant pipe and metal plates.

In the present embodiment, as an example, the air conditioner 100 has been described as a dedicated cooling system operating only in the cooling mode. However, the air conditioner 100 is not limited to a dedicated cooling system, it may be a cooling-heating system operating in both the cooling mode and the heating mode. In this case, the flow of the refrigerant may be switched between the cooling mode and the heating mode by a four-way valve or the like connected to the compressor 1. Specifically, in the cooling mode, the refrigerant discharged from the compressor 1 flows through the four-way valve to the heat exchanger (outdoor heat exchanger) 13, and in the heating mode, the refrigerant discharged from the compressor 1 flows through the four-way valve to the indoor heat exchanger 21.

Next, the effect of the present embodiment will be described.

According to the outdoor unit 10 of the present embodiment, since the upper end 15*a* of the duct 15 protrudes upward higher than the lower end of the heat exchanger 13, the upper end 15*a* of the duct 15 can be brought closer to the fan 12 than the lower end of the heat exchanger 13. Therefore, it is possible to increase the flow rate of the air flowing upward around the upper end 15*a* of the duct 15. The air flowing upward around the upper end 15*a* of the duct 15 will draw the air inside the duct 15 upward, whereby it is possible to increase the flow rate of the air flowing inside the duct 15. As a result, the heat radiation member 14*b* can be sufficiently cooled by the air flowing inside the duct 15.

When the heat radiation member 14*b* is not accommodated in the duct 15, in order to ensure heat radiation, the heat radiation member 14*b* have to be made larger in size. On the contrary, in the present embodiment, since the heat radiation member 14*b* is accommodated in the duct 15, the amount of wind required for heat radiation is supplied to the heat radiation member 14*b* by the air flowing inside the duct 15. Therefore, the heat radiation member 14*b* may be made smaller in size.

According to the outdoor unit 10 of the present embodiment, the bottom face 11*b* of the casing 11 covers the entire lower end of the internal space of the casing 11, and no opening is provided on the bottom face 11*b*. Therefore, compared with the case where an opening is provided on the bottom face 11*b* of the casing 11, it is possible to prevent insects, dust and the like from entering the casing 11 via the opening.

Since no opening is provided on the bottom face 11*b*, no air is sucked into the casing 11 from the opening. Therefore, the machinery section 11*f* of the casing 11 becomes a substantially windless environment. As described above, according to the outdoor unit 10 of the present embodiment, since the upper end 15*a* of the duct 15 protrudes upward higher than the lower end of the heat exchanger 13, it is possible to increase the flow rate of the air flowing inside the duct 15. Therefore, even if no opening is provided on the bottom face 11*b*, the heat radiation member 14*b* can be sufficiently cooled by the air flowing inside the duct 15.

According to the outdoor unit 10 of the present embodiment, the heat exchange section 11*e*and the machinery section 11*f* communicate with each other in both the duct 15 and the region around the duct 15. As described in PTL 1, when the internal space of the casing 11 is partitioned by a horizontal partition plate into the heat exchange section 11*e*and the machinery section 11*f*, the volume of the machinery section 11*f* is small, and thereby, when the casing 11 is exposed to direct sunlight, the temperature of the machinery section 11*f* is apt to rise. Therefore, the service life of the electrical component 14*a* and the like installed in the machinery section 11*f* is shortened. On the contrary, in the present embodiment, since the heat exchange section 11*e*and the machinery section 11*f* communicate with each other in the region around the duct 15, the hot air inside the machinery section 11*f* will flow into the heat exchange section 11*e*, and will be discharged via the air outlet 11*a*. As a result, the temperature rise in the machinery section 11*f* is suppressed, which makes it possible to prolong the service life of the electrical component 14*a* and the like.

According to the outdoor unit 10 of the present embodiment, the heat exchanger 13 is disposed inside the heat exchange section 11*e*along each of the first side face 11*c*1, the second side face 11*c*2, the third side face 11*c*3 and the fourth side face 11*c*4. In a conventional outdoor unit 10, the heat exchanger 13 is not disposed along at least one side face of the first side face 11*c*1, the second side face 11*c*2, the third side face 11*c*3 and the fourth side face 11*c*4, and the control box 14 is attached to that side face. On the contrary, according to the outdoor unit 10 of the present embodiment, the heat exchanger 13 is disposed along all of the first side face 11*c*1, the second side face 11*c*2, the third side face 11*c*3, and the fourth side face 11*c*4. Thus, compared to the case where the heat exchanger 13 is not disposed along at least one side face of the first side face 11*c*1, the second side face 11*c*2, the third side face 11*c*3 and the fourth side face 11*c*4 as in a conventional outdoor unit 10, the area of the heat exchanger 13 in contact with air is made larger, which makes it possible to improve the heat exchange efficiency.

The air conditioner 100 according to the present embodiment includes the outdoor unit 10 described above and the indoor unit 20 including the indoor heat exchanger 21. Therefore, it is possible to sufficiently cool the heat radiation member 14*b* of the outdoor unit 10 included in the air conditioner 100.

Next, various modifications of the present embodiment will be described. Since the configuration of each of the various modifications of the present embodiment is the same as that of the present embodiment unless otherwise specified, the same elements will be denoted by the same reference numerals, and the description thereof will not be repeated.

Figure 6:
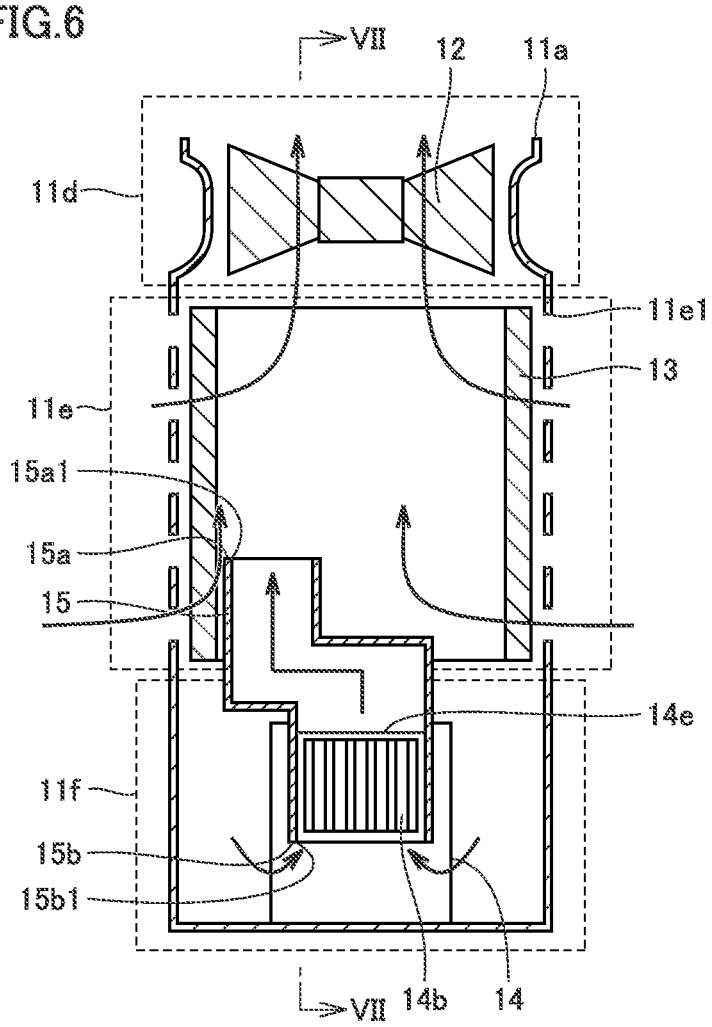
FIG. 6 is a cross-sectional view schematically illustrating the configuration of an air conditioner according to a first modification of the first embodiment of the present invention.
Figure 7:
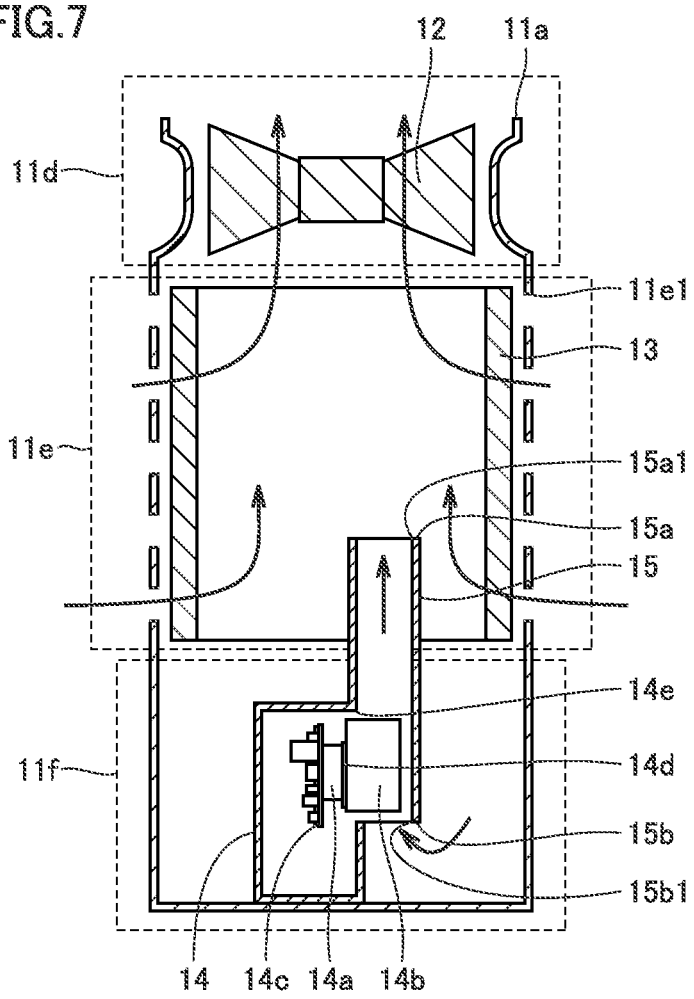
FIG. 7 is a cross-sectional view taken along the line VII-VII of FIG. 6.

An outdoor unit 10 according to a first modification of the present embodiment will be described with reference to FIGS. 6 and 7. As illustrated in FIGS. 6 and 7, in the outdoor unit 10 according to the first modification of the present embodiment, the duct 15 is bent in the horizontal direction between the upper end 15*a* and the lower end 15*b*. As long as the upper end 15*a* of the duct 15 protrudes upward higher than the lower end of the heat exchanger 13, the duct may be bent or curved between both ends.

In some cases, it may be difficult to form the duct 15 linear in the vertical direction due to the balance of arrangement with the other components (elements or the like) to be mounted on the outdoor unit 10. In such a case, according to the outdoor unit 10 of the first modification of the present embodiment, it is possible to dispose the duct 15 so as to circumvent the other components (elements or the like). Therefore, it is possible to improve the degree of freedom of arranging the other components (elements or the like).

As the number of bends in the duct 15 increases, the pressure loss will increase, and accordingly, the volume and the flow rate of the wind passing through the heat radiation member 14*b* will decrease, which decreases the cooling efficiency. Therefore, it is preferable that the number of bends in the duct 15 is as less as possible. In the outdoor unit 10 according to the first modification of the present embodiment, since the number of bends in the duct 15 is one, it is possible to prevent the pressure loss from increasing, and consequently prevent the cooling efficiency from decreasing.

Figure 8:
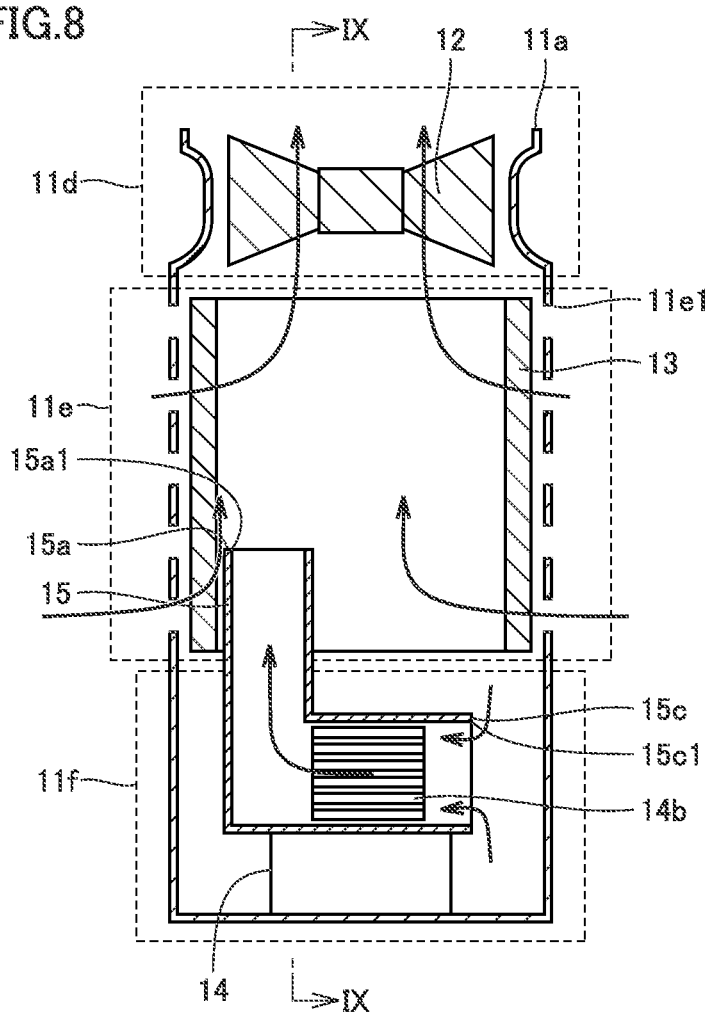
FIG. 8 is a cross-sectional view schematically illustrating the configuration of an air conditioner according to a second modification of the first embodiment of the present invention.
Figure 9:
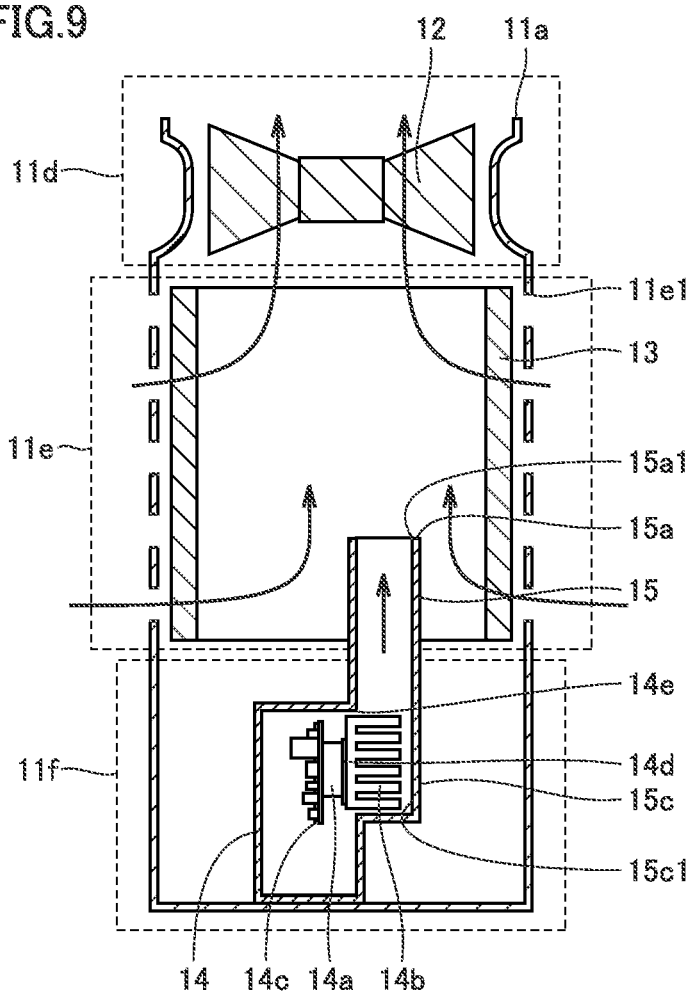
FIG. 9 is a cross-sectional view taken along line IX-IX in FIG. 8.

Next, an outdoor unit 10 according to a second modification of the present embodiment will be described with reference to FIGS. 8 and 9. As illustrated in FIGS. 8 and 9, in the outdoor unit 10 according to the second modification of the present embodiment, the opening 15*c*1 at one end 15*c* of the duct 15 disposed in the machinery section 11*f* opens in the horizontal direction. Note that the opening of the duct 15 is not required to open in the vertical direction.

In the second modification of the present embodiment, the feathers of the heat radiation fin are arranged parallel to the horizontal direction. Thereby, it is possible to prevent the air flow from the opening 15*c*1 into the duct 15 from being disturbed by the heat radiation fin.

Second Embodiment

Hereinafter, in the second embodiment, unless otherwise specified, the same components as those in the first embodiment will be denoted by the same reference numerals, and the description thereof will not be repeated. An outdoor unit 10 according to the second embodiment will be described with reference to FIGS. 10 to 12.

Figure 10:
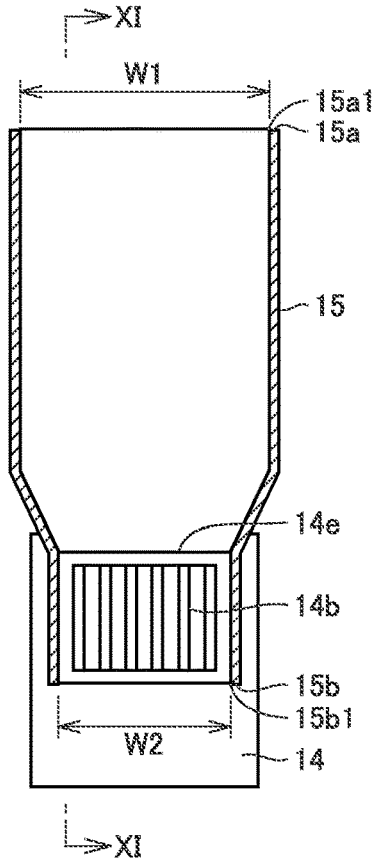
FIG. 10 is a cross-sectional view schematically illustrating the configuration of a duct provided in an outdoor unit according to a second embodiment of the present invention.
Figure 11:
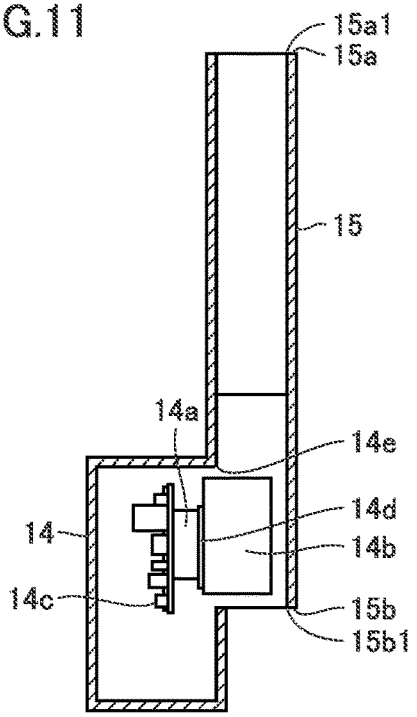
FIG. 11 is a cross-sectional view taken along line XI-XI in FIG. 10.
Figure 12:
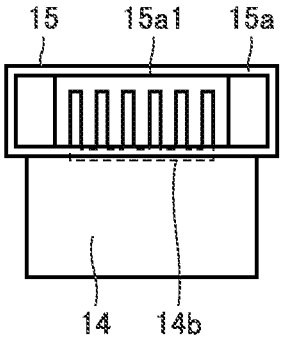
FIG. 12 is a top view schematically illustrating the configuration of the duct illustrated in FIG. 10.

As illustrated in FIGS. 10 to 12, in the outdoor unit 10 of the present embodiment, an opening area of the duct 15 at the upper end 15*a* of the duct 15 is larger than an inner cross-sectional area of the duct 15 at the position where the duct 15 accommodates the heat radiation member 14*b*. In other words, the opening area of the opening 15*a*1 at the upper end 15*a* of the duct 15 is larger than the inner cross-sectional area of the duct 15 at the portion enclosing the heat radiation member 14*b*. Specifically, the width W1 of the opening 15*a*1 at the upper end 15*a* of the duct 15 is larger than the width W2 of the opening 15*b*1 at the lower end 15*b* of the duct 15. The width W2 of the opening 15*b*1 at the lower end 15*b* of the duct 15 is equal to the width of the duct 15 at the position where the duct 15 accommodates the heat radiation member 14*b*. The width of the duct 15 changes linearly. Further, the depth of the duct 15 is constant from the upper end 15*a* to the lower end 15*b*.

It should be noted that the width of the duct 15 may not change linearly. Specifically, the width of the duct 15 may change curvilinearly. Compared with the case where the width of the duct 15 changes linearly, when the width of the duct 15 changes curvilinearly, it is possible to reduce the pressure loss of the air flowing inside the duct 15.

In the outdoor unit 10 of the present embodiment, the air flow inside the casing 11 is generated by the fan 12 arranged at the uppermost part of the casing 11. Therefore, as the opening area of the duct 15 is increased by enlarging the opening 15*a*1 at the upper end 15*a* of the duct 15, more air around the opening 15*a*1 will be drawn upward. As a result, the flow rate of the air drawn upward from the inside of the duct 15 will be increased.

According to the outdoor unit 10 of the present embodiment, the opening area of the duct 15 at the upper end 15*a* of the duct 15 is larger than the inner cross-sectional area of the duct 15 at the position where the duct 15 accommodates the heat radiation member 14*b*. Therefore, it is possible to increase the flow rate of the air drawn upward from the inside of the duct 15. Therefore, the flow rate of the air flowing inside the duct 15 can be increased. As a result, the heat radiation member 14*b* can be sufficiently cooled by the air flowing inside the duct 15.

The volume of air inside the continuous duct 15 is equal to the product of the flow rate of the air and the inner cross-sectional area of the duct. Therefore, the flow rate of the air passing through the heat radiation member 14*b* will be increased when the inner cross-sectional area of a portion of the duct 15 enclosing the heat radiation member 14*b* is made smaller than the opening area of the opening 15*a*1 at the upper end 15*a* of the duct 15.

In addition, when the cross-sectional area of the opening 15*a*1 at the upper end 15*a* of the duct 15 is made larger, more air around the duct 15 will be drawn upward by the fan 12, which makes the flow rate of the air flowing out from the duct 15 greater. Therefore, the flow rate of the air inside the duct 15 will become faster than the case when the inner cross-sectional area of the duct 15 is constant at the portion enclosing the heat radiation member 14*b*, which makes it possible to make the heat radiation member 14*b* further smaller in size.

The embodiments described above may be combined appropriately.

The embodiments disclosed herein are merely by way of example and not limited thereto. The scope of the present invention is defined by the terms of the claims, rather than the description above, and is intended to include any modifications within the meaning and scope equivalent to the terms of the claims.

REFERENCE SIGNS LIST

1: compressor; 2: throttle device; 10: outdoor unit: 11: casing; 11*a*: air outlet; 11*b*: bottom face; 11*c*: side face; 11*c*1: first side face; 11*c*2: second side face; 11*c*3: third side face; 11*c*4: fourth side face; 11*d*: fan section; 11*e*: heat exchange section; 11*f*: machinery section; 12: fan; 13: heat exchanger; 14: control box; 14*a*: electrical component; 14*b*: heat radiation member; 14*c*: printed circuit board; 14*d*: heat conduction member; 14*e*, 15*a*1, 15*b*1, 15*c*1: opening; 15: duct; 15*a*: upper end; 15*b*: lower end; 15*c*: end; 20: indoor unit; 21: indoor heat exchanger; 100: air conditioner

The invention claimed is:

1. An outdoor unit comprising:

a casing having an air outlet, a heat exchange section and a machinery section;

a fan disposed inside the casing and configured to blow air to the outside of the casing via the air outlet;

a heat exchanger disposed inside the casing at a position lower than the fan and disposed in the heat exchange section;

an electrical component disposed inside the casing in the machinery section at a position lower than the heat exchange section;

a heat radiation member connected to the electrical component inside the machinery section of the casing and disposed in the machinery section; and a duct configured to accommodate at least a part of the heat radiation member inside the casing and extend in the vertical direction;

an upper end of the duct being configured to protrude upward higher than a lower end of the heat exchanger and have an opening inside the heat exchanger, and a lower end of the duct being configured to have an opening inside the machinery section.

2. The outdoor unit according to claim 1, wherein a plurality of suction ports are provided on a side face of the heat exchange section of the casing, and no opening is provided on a side face of the machinery section.

3. The outdoor unit according to claim 2, wherein the plurality of suction ports includes a suction portion provided lower than the upper end of the duct.

4. The outdoor unit according to claim 1, wherein the casing includes a bottom face, the bottom face is configured to cover the entire lower end of an internal space of the casing, and no opening is provided on the bottom face.

5. The outdoor unit according to claim 1, wherein an opening area of the duct at the upper end of the duct is larger than an inner cross-sectional area of the duct at a position where the duct accommodates the heat radiation member.

6. The outdoor unit according to claim 1, wherein the heat exchange section and the machinery section communicate with each other both in the duct and in a region around the duct.

7. The outdoor unit according to claim 6, wherein the casing includes a first side face, a second side face connected to the first side face, a third side face connected to the second side face and facing the first side face, and a fourth side face connected to the first side face and the third side face and facing the second side face, and the heat exchanger is disposed inside the heat exchange section along each of the first side face, the second side face, the third side face and the fourth side face.

8. The outdoor unit according to claim 1, wherein a horizontal section of the duct includes a central point of an area surrounded by the heat exchanger.

9. The outdoor unit according to claim 1, wherein a rotation of the fan creates an air flow around the opening at the upper end of the duct that is disposed in the heat exchange section toward the upper direction, and the air around the opening at the upper end of the duct and the air inside the duct are drawn upward by the air flow.

10. An air conditioner comprising:

the outdoor unit according to claim 1; and an indoor unit including an indoor heat exchanger.

* * * * *